US006083856A

United States Patent [19]

Joseph et al.

[11] Patent Number: 6,083,856

[45] Date of Patent: Jul. 4, 2000

[54] ACRYLATE COPOLYMERIC FIBERS

[75] Inventors: Eugene G. Joseph, Arden Hills; Ashish Khandpur, Roseville; Kenneth C. Williams, Hudson; Anthony R. Clanton; Steven C. Stickels, both of Woodbury; Randy A. Hoff, Hudson, all of Minn.

[73] Assignee: 3M Innovative Properties Company, St. Paul, Minn.

[21] Appl. No.: 08/982,238

[22] Filed: Dec. 1, 1997

[51] Int. Cl.[7] ..... C09J 7/02

[52] U.S. Cl. ..... 442/361; 442/440; 442/401; 428/343; 428/355 AC

[58] Field of Search ..... 428/343, 355 AC; 442/361, 400, 401

[56] References Cited

U.S. PATENT DOCUMENTS

| | | | |
|---|---|---|---|
| Re. 24,906 | 12/1960 | Ulrich | 206/59 |
| 3,338,992 | 8/1967 | Kinney | 264/24 |
| 3,480,502 | 11/1969 | Schrenk | 156/271 |
| 3,487,505 | 1/1970 | Chisholm et al. | 18/13 |
| 3,502,763 | 3/1970 | Hartmann | 264/210 |
| 3,644,252 | 2/1972 | Shenfeld et al. | 260/27 R |
| 3,786,116 | 1/1974 | Milkovich et al. | 260/885 |
| 3,842,059 | 10/1974 | Milkovich et al. | 260/93.5 |
| 3,971,373 | 7/1976 | Braun | 128/146.2 |
| 4,379,201 | 4/1983 | Heilmann et al. | 428/345 |
| 4,405,297 | 9/1983 | Appel et al. | 425/72 |
| 4,551,388 | 11/1985 | Schlademan | 428/355 |
| 4,554,324 | 11/1985 | Husman et al. | 525/301 |
| 4,619,979 | 10/1986 | Kotnour et al. | 526/88 |
| 4,663,220 | 5/1987 | Wisneski et al. | 428/221 |
| 4,737,559 | 4/1988 | Kellen et al. | 526/291 |
| 4,843,134 | 6/1989 | Kotnour et al. | 526/318.4 |
| 4,910,064 | 3/1990 | Sabee | 428/113 |
| 5,176,952 | 1/1993 | Joseph et al. | 428/284 |
| 5,200,246 | 4/1993 | Sabee | 428/109 |
| 5,232,770 | 8/1993 | Joseph | 428/284 |
| 5,238,733 | 8/1993 | Joseph et al. | 428/284 |
| 5,242,754 | 9/1993 | Yang | 428/355 |
| 5,248,455 | 9/1993 | Joseph et al. | 264/6 |
| 5,258,220 | 11/1993 | Joseph | 428/284 |

(List continued on next page.)

FOREIGN PATENT DOCUMENTS

| | | | |
|---|---|---|---|
| 0 658 351 A1 | 12/1994 | European Pat. Off. | A61L 15/58 |
| 2-18482 | 7/1988 | Japan | C09J 7/02 |
| 7-109443 | 10/1993 | Japan | C09J 7/00 |
| 6-108018 | 4/1994 | Japan | C09J 7/02 |
| 6-89304 | 11/1994 | Japan | C09J 7/02 |
| WO 92/16361 | 10/1992 | WIPO | D04H 13/00 |
| WO 96/16625 | 6/1996 | WIPO | A61F 13/15 |
| WO 96/23915 | 8/1996 | WIPO . | |
| WO 96/25469 | 8/1996 | WIPO | C09J 121/00 |
| WO 96/34028 | 10/1996 | WIPO | C08G 18/61 |
| WO 96/34029 | 10/1996 | WIPO | C08G 18/61 |
| WO 96/34030 | 10/1996 | WIPO | C08G 18/61 |
| WO 96/35458 | 11/1996 | WIPO . | |
| WO 97/23577 | 7/1997 | WIPO | C09J 7/02 |

OTHER PUBLICATIONS

*Handbook of Pressure Sensitive Adhesive Technology,* Second Edition, E. Satas, ed., Van Nostrand Reinhold, New York, NY 1989, pp. 171–176.

Y. Yamashita et al., *Polymer Journal,* vol. 14, pp. 255–260 (1982).

K. Ito et al., *Macromolecules,* vol. 13, pp. 216–221 (1980).

Wente, "Superfine Thermoplastic Fibers", *Industrial Engineering Cehmistry,* vol. 48, pp. 1342 et seq. (1956).

Wente et al., "Manufacture of Superfine Organic Fibers", *Report No. 4346 of the Naval Research Laboratories,* May 25, 1954.

Smorada, R.L., "Spunbonded Technology: An Historical Perspective", *Inda JNR,* vol. 3, No. 4, pp. 26–31 (undated).

*Primary Examiner*—Jenna Davis

*Attorney, Agent, or Firm*—Gary L. Griswold; Robert W. Sprague; William J. Bond

[57] ABSTRACT

The present invention provides fibers and products produced therefrom, including nonwoven webs and adhesive articles. The fibers, which can be multilayer fibers, include a pressure-sensitive adhesive composition comprising an acrylate copolymer comprising copolymerized monomers comprising at least one monofunctional alkyl (meth)acrylate monomer and at least one monofunctional free-radically copolymerizable reinforcing monomer having a homopolymer glass transition temperature higher than that of the alkyl (meth)acrylate monomer.

53 Claims, 1 Drawing Sheet

U.S. PATENT DOCUMENTS

| | | | |
|---|---|---|---|
| 5,262,479 | 11/1993 | Tobing | 525/71 |
| 5,272,023 | 12/1993 | Yamamoto et al. | 428/198 |
| 5,290,615 | 3/1994 | Tushaus et al. | 428/40 |
| 5,290,626 | 3/1994 | Nishio et al. | 428/224 |
| 5,302,447 | 4/1994 | Ogata et al. | 428/288 |
| 5,316,836 | 5/1994 | Heindel et al. | 428/284 |
| 5,324,580 | 6/1994 | Allan et al. | 428/284 |
| 5,352,516 | 10/1994 | Therriault et al. | 428/355 |
| 5,461,134 | 10/1995 | Leir et al. | 528/14 |
| 5,462,538 | 10/1995 | Korpman | 604/372 |
| 5,506,279 | 4/1996 | Babu et al. | 522/34 |
| 5,512,650 | 4/1996 | Leir et al. | 528/14 |
| 5,637,646 | 6/1997 | Ellis | 525/309 |
| 5,681,305 | 10/1997 | Korpman | 604/390 |
| 5,741,840 | 4/1998 | Lindquist et al. | 524/271 |

ACRYLATE COPOLYMERIC FIBERS

FIELD OF THE INVENTION

The present invention is directed to fibers, particularly microfibers, of acrylate copolymers, as well as products produced therefrom.

BACKGROUND OF THE INVENTION

Fibers having a diameter of no greater than about 100 microns ($\mu$m), and particularly microfibers having a diameter of no greater than about 50 $\mu$m, have been developed for a variety of uses and with a variety of properties. They are typically used in the form of nonwoven webs that can be used in the manufacture of face masks and respirators, air filters, vacuum bags, oil and chemical spill sorbents, thermal insulation, first aid dressings, medical wraps, surgical drapes, disposable diapers, wipe materials, and the like. The fibers can be made by a variety of melt processes, including a spunbond process and a melt-blown process.

In a spunbond process, fibers are extruded from a polymer melt stream through multiple banks of spinnerets onto a rapidly moving, porous belt, for example, forming an unbonded web. This unbonded web is then passed through a bonder, typically a thermal bonder, which bonds some of the fibers to neighboring fibers, thereby providing integrity to the web. In a melt-blown process, fibers are extruded from a polymer melt stream through fine orifices using high air velocity attenuation onto a rotating drum, for example, forming an autogenously bonded web. In contrast to a spunbond process, no further processing is necessary.

Fibers formed from either melt process can contain one or more polymers, and can be of one or more layers, which allows for tailoring the properties of the fibers and products produced therefrom. For example, melt-blown multilayer microfibers can be produced by first feeding one or more polymer melt streams to a feedblock, optionally separating at least one of the polymer melt streams into at least two distinct streams, and recombining the melt streams, into a single polymer melt stream of longitudinally distinct layers, which can be of at least two different polymeric materials arranged in an alternating manner. The combined melt stream is then extruded through fine orifices and formed into a highly conformable web of melt-blown microfibers.

Thermoplastic materials, such as thermoplastic elastomers, can be used in the melt processing of fibers, particularly microfibers. Examples of such thermoplastic materials include polyurethanes, polyetheresters, polyamides, polyarenepolydiene block copolymers such as those sold under the trade designation KRATON, and blends thereof. It is known that such thermoplastic materials can be either adhesive in nature or can be mixed with tackifying resins to increase the adhesiveness of the materials. For example, webs of microfibers made using a melt-blown process from pressure-sensitive adhesives comprising block copolymers, such as styrene-isoprene-styrene block copolymers available under the trade designation KRATON, are disclosed in International Publication No. WO 96/16625 (The Proctor & Gamble Company) and U.S. Pat. No. 5,462,538 (Korpman). Also, webs of multilayer microfibers made using a melt-blown process from tackified elastomeric materials, such as KRATON block copolymers, are disclosed in U.S. Pat. Nos. 5,176,952 (Joseph et al.), 5,238,733 (Joseph et al.), and 5,258,220 (Joseph).

Thus, nonwoven webs are known that are formed from melt-processed fibers having a variety of properties, including adhesive and nonadhesive properties. Not all polymeric materials, however, are suitable for use in melt processes used to make such fibers. This is particularly true for materials that are pressure-sensitive adhesives, typically because the extreme conditions used in melt processes can cause significant breakdown of molecular weights of the polymers resulting in low cohesive strength of the fiber. Thus, there is still a need for nonwoven webs of fibers having a variety of properties, particularly pressure-sensitive adhesive properties.

SUMMARY OF THE INVENTION

The present invention provides pressure-sensitive adhesive fibers and products produced therefrom, including nonwoven webs and adhesive articles. The fibers, which can be multilayer fibers, include a pressure-sensitive adhesive (PSA) composition comprising an acrylate copolymer as a structural component of the fibers. By this it is meant that the acrylate copolymer is an integral component of the fiber itself and not simply a post-fiber formation coating.

The acrylate copolymer includes both acrylate- and metharylate-based polymers. The acrylate copolymer comprising copolymerized monomers comprising at least one monofunctional alkyl (meth)acrylate monomer and at least one monofunctional free-radically copolymerizable reinforcing monomer having a homopolymer glass transition temperature higher than that of the alkyl (meth)acrylate monomer. The alkyl (meth)acrylate monomer, which includes both alkyl acrylates and alkyl methacrylates, when homopolymerized preferably has a glass transition temperature of no greater than about 0° C. The free-radically copolymerizable reinforcing monomer when homopolymerized preferably has a glass transition temperature of at least about 10° C.

The fibers can also include a secondary melt processable polymer or copolymer, such as a polyolefin, a polystyrene, a polyurethane, a polyester, a polyamide, styrenic block copolymer, an epoxy, a vinyl acetate, and mixtures thereof. Either the acrylate copolymer, the secondary melt processable polymer or copolymer, or both can be tackified. For example, the secondary melt processable polymer or copolymer can be a tackified styrenic block copolymer.

The secondary melt processable polymer or copolymer can be mixed (e.g., blended) with the acrylate copolymer or in a separate layer. For example, the fibers of the present invention can include at least one layer (a first layer) of a pressure-sensitive adhesive composition comprising an acrylate copolymer. Other layers can include different acrylate copolymers or secondary melt processable polymers or copolymers. For example, the fibers of the present invention can include at least one layer (a second layer) of a secondary melt processable polymer or copolymer.

The acrylate copolymer is preferably the reaction product of a monofunctional alkyl (meth)acrylate monomer, such as a monomer selected from the group of 2-methylbutyl acrylate, isooctyl acrylate, lauryl acrylate, poly(ethoxylated) methoxy acrylate, and mixtures thereof, and a monofunctional (meth)acrylic reinforcing monomer, such as a monomer selected from the group of an acrylic acid, a methacrylic acid, an acrylate, an acrylamide, and mixtures thereof. Preferably, the monofunctional acrylic reinforcing monomer is selected from the group of acrylic acid, N,N-dimethyl acrylamide, 1,1,3,3-tetramethylbutyl acrylamide, 2-hydroxypropyl acrylate, 2-(phenoxy)ethyl acrylate, and mixtures thereof.

Preferably, the acrylate copolymer further comprises a crosslinking agent, preferably, a copolymerized crosslinking agent, which can be an acrylic crosslinking monomer, a polymeric crosslinking material having a copolymerizable vinyl group, or mixtures thereof. Preferred crosslinking agents, if used, are polymeric crosslinking materials having a copolymerizable vinyl group, such as a (meth)acrylate-terminated polystyrene macromer and a (meth)acrylate-terminated polymethyl methacrylate macromer.

The present invention also provides a nonwoven web that includes the fibers described above. The nonwoven web can be in the form of a commingled web of various types of fibers. These various types of fibers may be in the form of separate layers within the nonwoven web, or they may be intimately mixed such that the web has a substantially uniform cross-section. In addition to the fibers that include an acrylate copolymer, the nonwoven web can further include fibers selected from the group of thermoplastic fibers, carbon fibers, glass fibers, mineral fibers, organic binder fibers, and mixtures thereof. The nonwoven web can also include particulate material.

The present invention also provides an adhesive article. The adhesive article, which may be in the form of a tape, includes a backing and a layer of a nonwoven web laminated to at least one major surface of the backing. The nonwoven web includes acrylate fibers and forms a pressure-sensitive adhesive layer.

DETAILED DESCRIPTION OF PREFERRED EMBODIMENTS

Figure 1:
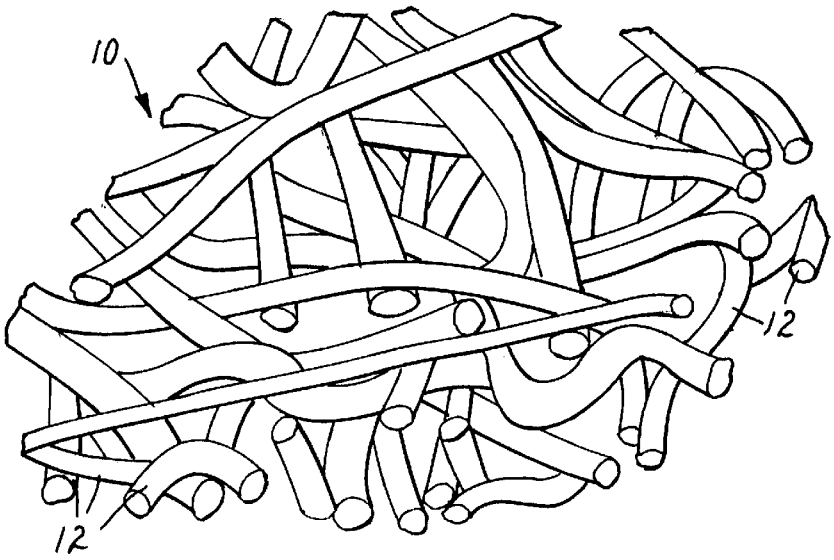
FIG. 1 is a perspective view of a nonwoven web of the present invention made from multilayer fibers.

The present invention is directed to coherent fibers comprising an acrylate pressure-sensitive adhesive copolymer. Such acrylate-based pressure-sensitive adhesive fibers typically have a diameter of no greater than about 100 $\mu$m and are useful in making coherent nonwoven webs that can be used in making a wide variety of products. Preferably, such fibers have a diameter of no greater than about 50 $\mu$m, and often, no greater than about 25 $\mu$m. Fibers of no greater than about 50 $\mu$m are often referred to as "microfibers."

Acrylate pressure-sensitive adhesive copolymers are advantageous because they show desirable adhesive properties over a broad temperature range to a wide variety of substrates. Such materials possess a four-fold balance of adhesion, cohesion, stretchiness, and elasticity, and a glass transition temperature ($T_g$) of less than about 20° C. Thus, they are tacky to the touch at room temperature (e.g., about 20° C. to about 25° C.), as can be determined by a finger tack test or by conventional measurement devices, and can easily form a useful adhesive bond with the application of light pressure. An acceptable quantitative description of a pressure-sensitive adhesive is given by the Dahlquist criterion line (as described in the *Handbook of Pressure Sensitive Adhesive Technology,* Second Edition, D. Satas, ed., Van Nostrand Reinhold, New York, N.Y. 1989, pages 171–176), which typically indicates that materials have a storage modulus (G') of less than about $3\times10^5$ Pascals (measured at 10 radian/second at a temperature of about 20° C. to about 22° C.) have pressure sensitive adhesive properties while materials having a G' in excess of this value do not (and are referred to herein as nonpressure-sensitive adhesive materials).

Fibers made of such polymers, and nonwoven webs of such fibers, are particularly desirable because they provide an adhesive material with a high surface area. The nonwoven webs also have high porosity. Nonwoven pressure-sensitive adhesive webs having a high surface area and porosity are desirable because they possess the desirable characteristics of breathability, moisture transmission, conformability, and good adhesion to irregular surfaces.

Suitable acrylate copolymers are those that are capable of being extruded and forming fibers in a melt process, such as a spunbond process or a melt-blown process, without substantial degradation or gelling. That is, suitable acrylate copolymers are those that have a relatively low viscosity in the melt such that they can be readily extruded. Such polymers preferably have an apparent viscosity in the melt (i.e., at melt processing conditions) in a range of about 150 poise to about 800 poise as measured by either capillary rheometry or cone and plate rheometry. Preferred acrylate copolymers are those that are capable of forming a melt stream in a melt blown process that maintains its integrity with few, if any, breaks in the melt stream. That is, preferred acrylate copolymers have an extensional viscosity that allows them to be drawn effectively into fibers.

Fibers formed from suitable acrylate copolymers have sufficient cohesive strength and integrity at their use temperature such that a web formed therefrom maintains its fibrous structure. Sufficient cohesiveness and integrity typically depends on the inherent viscosity of the acrylate copolymer. Typically, sufficient cohesiveness and integrity occur in acrylate copolymers having an inherent viscosity of at least about 0.4, preferably, about 0.4 to about 1.5, and more preferably, about 0.4 to about 0.8, as measured by conventional means using a Cannon-Fensks #50 viscometer in a water bath controlled at 25° C. to measure the flow time of 10 ml of a polymer solution (0.2 g per deciliter polymer in ethyl acetate). Fibers comprising suitable acrylate copolymers also have relatively low or no cold flow, and display good aging properties, such that the fibers maintain their shape and adhesive properties over an extended period of time under ambient conditions.

To tailor the properties of the fibers, one or more acrylate copolymers or other non-acrylate polymers can be used to make conjugate fibers of the present invention. These different polymers can be in the form of polymeric mixtures (preferably, compatible polymeric blends), two or more layered fibers, sheath-core fiber arrangements, or in "island in the sea" type fiber structures. Generally, the acrylate-based pressure-sensitive adhesive components will provide at least a portion of the exposed outer surface of a multicomponent conjugate fiber. Preferably, with multilayered conjugate fibers, the individual components will be present substantially continuously along the fiber length in discrete zones, which zones preferably extend along the entire length of the fibers.

The non-acrylate polymers are melt processable (typically, thermoplastic) and may or may not have elastomeric properties. They also may or may not have adhesive properties. Such polymers (referred to herein as secondary melt processable polymers or copolymers) have relatively low shear viscosity in the melt such that they can be readily extruded, and drawn effectively to form fibers, as described above with respect to the acrylate copolymers. In the polymeric mixtures (e.g., polymeric blends), the non-acrylate copolymers may or may not be compatible with the acrylate copolymers, as long as the overall mixture is a fiber forming composition. Preferably, however, the rheological behavior in the melt of the polymers in a polymeric mixture are similar.

Figure 2:
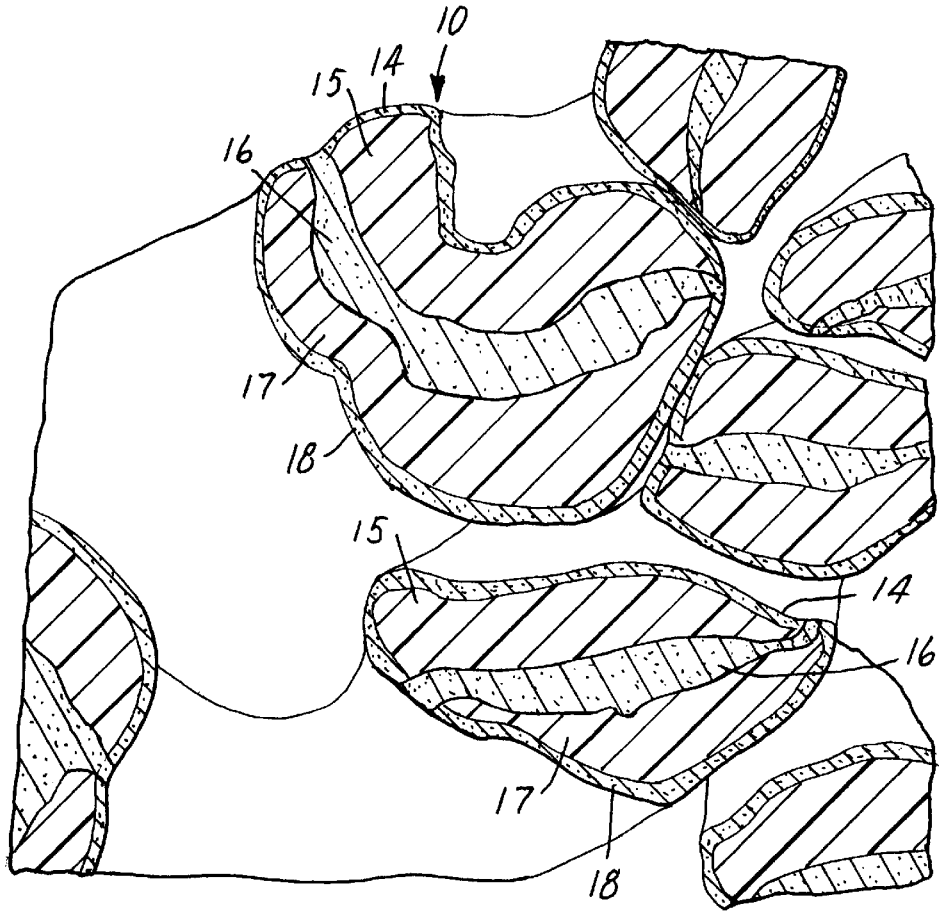
FIG. 2 is a cross-sectional view of the nonwoven web of FIG. 1 at higher magnification showing a five layer construction of the fibers.

FIG. 1 is an illustration of a nonwoven web 10 prepared from multilayered fibers 12 according to the present invention. FIG. 2 is a cross-sectional view of the nonwoven web 10 of FIG. 1 at higher magnification showing a five layer construction of the fibers 12. The multilayered fibers 12 each have five discrete layers of organic polymeric material. There are three layers 14, 16, 18 of one type of pressure-sensitive adhesive composition (e.g., an isooctyl acrylate/acrylic acid/poly(ethylene oxide) macromer terpolymer), and two layers 15, 17 of a second type of pressure-sensitive adhesive composition (e.g., an isooctyl acrylate/acrylic acid/methylacrylate-terminated polystyrene macromer terpolymer). It is significant to note, that the surface of the fibers have exposed edges of the layers of both materials. Thus, the fibers, and hence, the nonwoven webs, of the present invention, can demonstrate properties associated with both types of materials simultaneously. Although FIG. 1 illustrates a fiber having five layers of material, the fibers of the present invention can include fewer or many more layers, e.g., hundreds of layers. Thus, the coherent fibers of the present invention can include, for example, only one type of pressure-sensitive adhesive composition in one layer, two or more different types of pressure-sensitive adhesive compositions in two or more layers, or a pressure-sensitive adhesive composition layered with a nonpressure-sensitive adhesive composition in two or more layers. Each of the compositions can be a mixture of different pressure-sensitive adhesive materials and/or nonpressure-sensitive adhesive materials.

PREFERRED ACRYLATE COPOLYMERS

Preferred poly(acrylates) are derived from: (A) at least one monofunctional alkyl (meth)acrylate monomer (i.e., alkyl acrylate and alkyl methacrylate monomer); and (B) at least one monofunctional free-radically copolymerizable reinforcing monomer. The reinforcing monomer has a homopolymer glass transition temperature ($T_g$) higher than that of the alkyl (meth)acrylate monomer and is one that increases the glass transition temperature and modulus of the resultant copolymer. Monomers A and B are chosen such that a copolymer formed from them is extrudable and capable of forming fibers. Herein, "copolymer" refers to polymers containing two or more different monomers, including terpolymers, tetrapolymers, etc.

Preferably, the monomers used in preparing the pressure-sensitive adhesive copolymer fibers of the present invention include: (A) a monofunctional alkyl (meth)acrylate monomer that, when homopolymerized, generally has a glass transition temperature of no greater than about 0° C.; and (B) a monofunctional free-radically copolymerizable reinforcing monomer that, when homopolymerized, generally has a glass transition temperature of at least about 10° C. The glass transition temperatures of the homopolymers of monomers A and B are typically accurate to within ±5° C. and are measured by differential scanning calorimetry.

Monomer A, which is a monofunctional alkyl acrylate or methacrylate (i.e., (meth)acrylic acid ester), contributes to the flexibility and tack of the copolymer. Preferably, monomer A has a homopolymer $T_g$ of no greater than about 0° C. Preferably, the alkyl group of the (meth)acrylate has an average of about 4 to about 20 carbon atoms, and more preferably, an average of about 4 to about 14 carbon atoms. The alkyl group can optionally contain oxygen atoms in the chain thereby forming ethers or alkoxy ethers, for example, Examples of monomer A include, but are not limited to, 2-methylbutyl acrylate, isooctyl acrylate, lauryl acrylate, 4-methyl-2-pentyl acrylate, isoamyl acrylate, sec-butyl acrylate, n-butyl acrylate, n-hexyl acrylate, 2-ethylhexyl acrylate, n-octyl acrylate, isooctyl acrylate, n-decyl acrylate, isodecyl acrylate, isodecyl methacrylate, and isononyl acrylate. Other examples include, but are not limited to, polyethoxylated or -propoxylated methoxy (meth)acrylate (i.e., macromolecular monomers), polymethylvinyl ether mono (meth)acrylate macromers, and ethoxylated or propoxylated nonyl-phenol acrylate macromers. The molecular weight of such macromers is typically about 100 grams/mole to about 600 grams/mole, and preferably, about 300 grams/mole to about 600 grams/mole. Preferred monofunctional (meth-acrylates that can be used as monomer A include 2-methylbutyl acrylate, isooctyl acrylate, lauryl acrylate, and poly(ethoxylated) methoxy acrylate (i.e., methoxy terminated poly(ethylene glycol) mono-acrylate or poly (ethyleneoxide) mono-methacrylate). Combinations of various monofunctional monomers categorized as an A monomer can be used to make the copolymer used in making the fibers of the present invention.

Monomer B, which is a functional free-radically copolymerizable reinforcing monomer; increases the glass transition temperature of the copolymer. As used herein, "reinforcing" monomers are those that increase the modulus of the adhesive, and thereby its strength. Preferably, monomer B has a homopolymer $T_g$ of at least about 10° C. More preferably, monomer B is a reinforcing monofunctional (meth)acrylic monomer, including an acrylic acid, a methacrylic acid, an acrylamide, and an acrylate. Examples of monomer B include, but are not limited to, acrylamides, such as acrylamide, methacrylamide, N-methyl acrylamide, N-ethyl acrylamide, N-methylol acrylamide, N-hydroxyethyl acrylamide, diacetone acrylamide, N,N-dimethyl acrylamide, N,N-diethyl acrylamide, N-ethyl-N-aminoethyl acrylamide, N-ethyl-N-hydroxyethyl acrylamide, N,N-dimethylol acrylamide, N,N-dihydroxyethyl acrylamide, t-butyl acrylamide, dimethylaminoethyl acrylamide, N-octyl acrylamide, and 1,1,3,3-tetramethylbutyl acrylamide. Other examples of monomer B include acrylic acid and methacrylic acid, itaconic acid, crotonic acid, maleic acid, fumaric acid 2,2-(diethoxy)ethyl acrylate, hydroxyethyl acrylate or methacrylate, 2-hydroxypropyl acrylate or methacrylate, methyl methacrylate, isobutyl acrylate, n-butyl methacrylate, isoburnyl acrylate, 2-(phenoxy)ethyl acrylate or methacrylate, biphenylyl acrylate, t-butylphenyl acrylate, cyclohexyl acrylate, dimethyladamantyl acrylate, 2-naphthyl acrylate, phenyl acrylate, N-vinyl pyrrolidone, and N-vinyl caprolactam. Preferred reinforcing monofunctional acrylic monomers that can be used as monomer B include acrylic acid, N,N-dimethyl acrylamide, 1,1,3,3-tetramethylbutyl acrylamide, 2-hydroxypropyl acrylate, and 2-(phenoxy)ethyl acrylate. Combinations of various reinforcing monofunctional monomers categorized as a B monomer can be used to make the copolymer used in making the fibers of the present invention.

The acrylate copolymer is preferably formulated to have a resultant $T_g$ of less than about 25° C. and more preferably, less than about 0° C. Such acrylate copolymers preferably include about 60 parts to about 98 parts per hundred of at least one alkyl (meth)acrylate monomer and about 2 parts to about 40 parts per hundred of at least one copolymerizable reinforcing monomer. Preferably, the acrylate copolymers have about 85 parts to about 98 parts per hundred or at least one alkyl (meth)acrylate monomer and about 2 parts to about 15 parts of at least one copolymerizable reinforcing monomer.

A crosslinking agent can be used if so desired to build the molecular weight and the strength of the copolymer, and hence improve the integrity and shape of the fibers. Preferably, the crosslinking agent is one that is copolymerized with monomers A and B. The crosslinking agent may produce chemical crosslinks (e.g., covalent bonds). Alternatively, it may produce physical crosslinks that result, for example, from the formation of reinforcing domains due to phase separation or acid base interactions. Suitable crosslinking agents are disclosed in U.S. Pat. Nos. 4,379,201 (Heilman), 4,737,559 (Kellen), 5,506,279 (Babu et al.), and 4,554,324 (Hussman).

The crosslinking agent is preferably not activated towards crosslinking until after the copolymer is extruded and the fibers are formed. Thus, the crosslinking agent can be a photocrosslinking agent, which, upon exposure to ultraviolet radiation (e.g., radiation having a wavelength of about 250 nanometers to about 400 nanometers), causes the copolymer to crosslink. Preferably, however, the crosslinking agent provides crosslinking, typically, physical crosslinking, without further processing. Physical crosslinking can occur through phase separation of domains which produces thermally reversible crosslinks. Thus, acrylate copolymers prepared from a crosslinker that provides reversible physical crosslinking are particularly advantageous in the preparation of fibers using a melt process.

Preferably, the crosslinking agent is (1) an acrylic crosslinking monomer, or (2) a polymeric crosslinking material having a copolymerizable vinyl group. More preferably, the crosslinking agent is a polymeric crosslinking material having a copolymerizable vinyl group. Preferably, each of these monomers is a free-radically polymerizable crosslinking agent capable of copolymerizing with monomers A and B. Combinations of various crosslinking agents can be used to make the polymer used in making the fibers of the present invention. It should be understood, however, that such crosslinking agents are optional.

The acrylic crosslinking monomer is preferably one that is copolymerized with monomers A and B and generates free radicals in the polymer backbone upon irradiation of the polymer. An example of such a monomer is an acrylated benzophenone as described in U.S. Pat. No. 4,737,559 (Kellen et al.).

The polymeric crosslinking materials that have a copolymerizable vinyl group are preferably represented by the general formula $X—(Y)_n—Z$ wherein: X is a copolymerizable vinyl group; Y is a divalent linking group where n can be zero or one; and Z is a monovalent polymeric moiety having a $T_g$ greater than about 20° C. and a weight average molecular weight in the range of about 2,000 to about 30,000 and being essentially unreactive under copolymerization conditions. Particularly preferred vinyl-terminated polymeric monomers useful in making the microfibers of the present invention are further defined as having: an X group which has the formula $HR^1C{=}CR^2—$ wherein $R^1$ is a hydrogen atom or a COOH group and $R^2$ is a hydrogen atom or a methyl group; a Z group which has the formula $—\{C(R)^3)(R^4)—CH_2\}_n—R^5$ wherein $R^3$ is a hydrogen atom or a lower (i.e., $C_1$–$C_4$) alkyl group, $R^5$ is a lower alkyl group, n is an integer from 20 to 500, and $R^4$ is a monovalent radical selected from the group consisting of $—C_6H_4R^6$ and $—CO_2R^7$ wherein $R^6$ is a hydrogen atom or a lower alkyl group and $R^7$ is a lower alkyl group.

Such vinyl-terminated polymeric crosslinking monomers are sometimes referred to as macromolecular monomers (i.e., "macromers"). Such monomers are known and may be prepared by the methods disclosed in U.S. Pat. Nos. 3,786,116 (Milkovich et al.) and 3,842,059 (Milkovich et al.), as well as Y. Yamashita et al., *Polymer Journal,* 14, 255–260 (1982), and K. Ito et al., *Macromolecules,* 13, 216–221 (1980). Typically, such monomers are prepared by anionic polymerization or free radical polymerization.

The vinyl-terminated polymeric crosslinking monomer, once polymerized with the (meth)acrylate monomer and the reinforcing monomer, forms a copolymer having pendant polymeric moieties which tend to reinforce the otherwise soft acrylate backbone, providing a substantial increase in the shear strength of the resultant copolymer adhesive. Specific examples of such crosslinking polymeric materials are disclosed in U.S. Pat. No. 4,554,324 (Husman et al.). Preferred vinyl-terminated polymeric monomers include a (meth)acrylate-terminated polystyrene macromer of the formula $X—(Y)_n—Z$ wherein X is $CH_2{=}CH—$ or $CH_2{=}C(CH_3)—$, Y is an ester group, n is 1, and Z is polyvinyl toluene (i.e., polystyrene), or a (meth)acrylate-terminated polymethyl methacrylate macromer of the formula $X—(Y)_n—Z$ wherein X is $CH_2{=}CH—$ or $CH_2{=}C(CH_3)—$, Y is an ester group, n is 1, and Z is polymethyl methacrylate.

If used, the crosslinking agent is used in an effective amount, by which is meant an amount that is sufficient to cause crosslinking of the pressure-sensitive adhesive to provide adequate cohesive strength to produce the desired final adhesion properties to the substrate of interest. Preferably, if used, the crosslinking agent is used in an amount of about 0.1 part to about 10 parts, based on the total amount of monomers.

If a photocrosslinking agent has been used, the adhesive in the form of fibers can be exposed to ultraviolet radiation having a wavelength of about 250 nm to about 400 nm. The radiant energy in this preferred range of wavelength required to crosslink the adhesive is about 100 millijoules/centimeter$^2$ (mJ/cm$^2$) to about 1,500 mJ/cm$^2$, and more preferably, about 200 mJ/cm$^2$ to about 800 mJ/cm$^2$.

PREPARATION OF ACRYLATE COPOLYMERS

The acrylate pressure-sensitive adhesives of the present invention can be synthesized by a variety of free-radical polymerization processes, including solution, radiation, bulk, dispersion, emulsion, and suspension polymerization processes. For example, the acrylate pressure-sensitive adhesives can be synthesized according to the method of U.S. Pat. No. Re 24,906 (Ulrich). In one solution polymerization method, the alkyl (meth)acrylate monomer and reinforcing copolymerizable monomer along with a suitable inert organic solvent are charged into a reaction vessel equipped with a stirrer, a thermometer, a condenser, an addition funnel, and a thermal controller. After the monomer mixture is charged into the reaction vessel, a concentrated thermal free radical initiator solution is added to the addition funnel. The reaction vessel, addition funnel, and their contents then purged with nitrogen to create an inert atmosphere. Once purged, the reaction mixture is heated, with stirring, to about 55° C., and the initiator is added to the monomer mixture in the reaction vessel. A 98–99 percent conversion is typically obtained after about 20 hours. Subsequent to polymerization, solvent is removed from the reaction mixture and the isolated polymer used to prepare the fibers of the present invention.

Another copolymerization method is the ultraviolet (UV) radiation initiated photopolymerization of the monomer mixture. This monomer mixture, along with a suitable photoinitiator, is coated onto a flexible carrier web and polymerized in an inert (i.e., oxygen free) atmosphere (e.g., a nitrogen atmosphere). A sufficiently inert atmosphere can be achieved by covering a layer of the photoactive coating with a plastic film which is substantially transparent to UV radiation, and irradiating through that film in air using fluorescent-type UV lamps which generally give a total radiation dose of about 500 mJ/cm$^2$.

Bulk polymerization methods, such as the continuous free radical polymerization method described in U.S. Pat. Nos. 4,619,979, or 4,843,134 (both to Kotnour et al.), the essentially adiabatic polymerization methods using a batch reactor described in U.S. Pat. No. 5,637,646 (Ellis), and the methods described for polymerizing packaged pre-adhesive compositions described in International Patent application Ser. No. WO 96/07522, may also be utilized to prepare the polymer used in the preparation of the fibers of the present invention.

Suitable free radical initiators include thermally activated initiators such as azo compounds such as 2,2'-azobis (isobutyronitrile), hydroperoxides such as tert-butyl hydroperoxide, peroxides such as benzoyl peroxide or cyclohexanone peroxide, and the like, and photoinitiators. Photoinitiators can be organic, organometallic, or inorganic compounds, but are most commonly organic. Examples of commonly used organic photoinitiators include benzoin and its derivatives, benzil ketals, acetophenone, acetophenone derivatives, benzophenone, and benzophenone derivatives. The initiator is generally used in an amount ranging from about 0.01 percent up to about 10 percent by weight of the total polymerizable mixture, preferably up to about 5 percent.

OPTIONAL ADDITIVES

The acrylate pressure-sensitive adhesive compositions of the present invention can include conventional additives such as tackifiers, plasticizers, flow modifiers, neutralizing agents, stabilizers, antioxidants, fillers, colorants, and the like, as long as they do not interfere in the fiber-forming melt process. Initiators that are not copolymerizable with the monomers used to prepare the acrylate copolymer can also be used to enhance the rate of polymerization and/or crosslinking. Such additives can be used in various combinations. If used, they are incorporated in amounts that do not materially adversely affect the desired properties of the pressure-sensitive adhesives or their fiber-forming properties. Typically, these additives can be incorporated into these systems in amounts of about 0.05 weight percent to about 25 weight percent, based on the total weight of the acrylate-based pressure-sensitive adhesive composition.

A wide variety of resinous (or synthetic) materials commonly used in the art to impart or enhance tack of pressure-sensitive adhesive compositions may be used as a tackifier (i.e., tackifying resin). Examples include rosin, rosin esters of glycerol or pentaerythritol, hydrogenated rosins, polyterpene resins such as polymerized beta-pinene, coumaroneindene resins, "C5" and "C9" polymerized petroleum fractions, and the like. The use of such tack modifiers is common in the art, as is described in the *Handbook of Pressure Sensitive Adhesive Technology,* Second Edition, D. Satas, ed., Van Nostrand Reinhold, New York, N.Y., 1989. A tackifying resin is added in amounts required to achieve the desired tack level. Examples of suitable commercially available tackifiers include synthetic ester resins, such as that available under the trade designation FORAL 85 from Hercules Inc., Wilmington, Del., and aliphatic/aromatic hydrocarbon resins, such as those available under the trade designation ESCOREZ 2000 from Exxon Chemical Co., Houston, Tex. This is typically achieved by adding from 1 part to about 300 parts by weight of tackifying resin per 100 parts by weight of an acrylate copolymer. The tackifying resin is selected to provide the acrylate copolymers with an adequate degree of tack to maintain the resultant composition balanced pressure-sensitive adhesive properties including shear and peel adhesion. As is known in the art, not all tackifier resins interact with the acrylate copolymer in the same manner; therefore, some minor amount of experimentation may be required to select the appropriate tackifier resin and to achieve optimum adhesive performance. Such minor experimentation is well within the capability of one skilled in the adhesive art.

OTHER POLYMERS

As discussed above, the acrylate copolymers of the present invention can be mixed (e.g., blended) and/or layered, for example, with other melt processable (typically, thermoplastic) polymers to tailor the properties of the fibers. Typically, the pressure-sensitive adhesive compositions used in making the fibers of the present invention that include mixtures of such secondary melt processable polymers or copolymers with the acrylates. The secondary melt processable polymers or copolymers can be used in an amount of about 1 weight percent up to about 99 weight percent, based on the total weight of the pressure-sensitive adhesive composition. Such secondary melt processable polymers or copolymers are extrudable and capable of forming fibers. They may or may not have pressure-sensitive properties. They may or may not have any adhesive properties, either at room temperature or in the melt state. They may or may not be mixed with other additives, such as tackifiers, plasticizers antioxidants, UV stabilizers, and the like. Examples of such secondary melt processable polymer or copolymers include, but are not limited to, polyolefins such as polyethylene, polypropylene, polybutylene, polyhexane, and polyoctene; polystyrenes; polyurethanes; polyesters such as polyethyleneterephthalate; polyamides such as nylon; styrenic block copolymers of the type available under the trade designation KRATON (e.g., styrene/isoprene/styrene, styrene/butadiene/styrene); epoxies; vinyl acetates such as ethylene vinyl acetate; and mixtures thereof. A particularly preferred secondary melt processable polymer or copolymer is a tackified styrenic block copolymer. It will be understood by one of skill in the art that layered fiber constructions can be formed having alternating pressure-sensitive and nonpressure-sensitive adhesive materials or alternating pressure-sensitive adhesive materials, for example.

PREPARATION OF FIBERS AND NONWOVEN WEBS

Melt processes for the preparation of fibers are well-known in the art. For example, such processes are disclosed in Wente, "Superfine Thermoplastic Fibers," in *Industrial Engineering Chemistry,* Vol. 48, pages 1342 et seq (1956); Report No. 4364 of the Naval Research Laboratories, published May 25, 1954, entitled "Manufacture of Superfine Organic Fibers" by Wente et al.; as well as in International Publication No. WO96/23915, and U.S. Pat. Nos. 3,338,992 (Kinney), 3,502,763 (Hartmann), 3,692,618 (Dorschner et al.), and 4,405,297 (Appel et al.). Such processes include both spunbond processes and melt-blown processes. A preferred method for the preparation of fibers, particularly microfibers, and nonwoven webs thereof, is a melt-blown process. For example, nonwoven webs of multilayer microfibers and melt-blown processes for producing them are disclosed in U.S. Pat. Nos. 5,176,952 (Joseph et al.), 5,232,770 (Joseph), 5,238,733 (Joseph et al.), 5,258,220 (Joseph), 5,248,455 (Joseph et al.). These and other melt processes can be used in the formation of the nonwoven webs of the present invention.

Melt-blown processes are particularly preferred because they form autogenously bonded webs that typically require no further processing to bond the fibers together. The melt-blown processes used in the formation of multilayer microfibers as disclosed in the Joseph (et al.) patents listed above are particularly suitable for use in making the multilayer microfibers of the present invention. Such processes use hot (e.g., equal to or about 20° C. to about 30° C. higher than the polymer melt temperature), high-velocity air to draw out and attenuate extruded polymeric material from a die, which will generally solidify after traveling a relatively short distance from the die. The resultant fibers are termed melt-blown fibers and are generally substantially continuous. They form into a coherent web between the exit die orifice and a collecting surface by entanglement of the fibers due in part to the turbulent airstream in which the fibers are entrained.

For example, U.S. Pat. No. 5,238,733 (Joseph et al.) describes forming a multicomponent melt-blown microfiber web by feeding two separate flow streams of organic polymeric material into a separate splitter or combining manifold. The split or separated flow streams are generally combined immediately prior to the die or die orifice. The separate flow streams are preferably established into melt streams along closely parallel flow paths and combined where they are substantially parallel to each other and the flow path of the resultant combined multilayered flow stream. This multilayered flow stream is then fed into the die and/or die orifices and through the die orifices. Air slots are disposed on either side of a row of the die orifices directing uniform heated air at high velocities at the extruded multicomponent melt streams. The hot high velocity air draws and attenuates the extruded polymeric material which solidified after traveling a relatively short distance from the die. Single layer microfibers can be made in an analogous manner with air attenuation using a single extruder, no splitter, and a single port feed die.

The solidified or partially solidified fibers form an interlocking network of entangled fibers, which are collected as a coherent web. The collecting surface can be a solid or perforated surface in the form of a flat surface or a drum, a moving belt, or the like. If a perforated surface is used, the backside of the collecting surface can be exposed to a vacuum or low-pressure region to assist in the deposition of the fibers. The collector distance is generally about 7 centimeters (cm) to about 130 cm from the die face. Moving the collector closer to the die face, e.g., about 7 cm to about 30 cm, will result in stronger inter-fiber bonding and a less lofty web.

The temperature of the separate polymer flowstreams is typically controlled to bring the polymers to substantially similar viscosities. When the separate polymer flowstreams converge, they should generally have an apparent viscosity in the melt (i.e., at melt blowing conditions) of about 150 poise to about 800 poise, as determined using a capillary rheometer. The relative viscosities of the separate polymeric flowstreams to be converged should generally be fairly well matched.

The size of the polymeric fibers formed depends to a large extent on the velocity and temperature of the attenuating airstream, the orifice diameter, the temperature of the melt stream, and the overall flow rate per orifice. Typically, fibers having a diameter of no greater than about 10 $\mu$m can be formed, although coarse fibers, e.g., up to about 50 $\mu$m or more, can be prepared using a melt-blown process, and up to about 100 $\mu$m, can be prepared using a spun bond process. The webs formed can be of any suitable thickness for the desired and intended end use. Generally, a thickness of about 0.01 cm to about 5 cm is suitable for most applications.

The acrylate fibers of the present invention can be mixed with other fibers, such as staple fibers, including inorganic and organic fibers, such as thermoplastic fibers, carbon fibers, glass fibers, mineral fibers, or organic binder fibers, as well as fibers of a different arylate copolymer or other polymers as described herein. The acrylate fibers of the present invention can also be mixed with particulates, such as sorbent particulate material. Typically, this is done prior to the fibers being collected by entraining particulates or other fibers in an airstream, which is then directed to intersect with the fiber streams. Alternatively, other polymer materials can be simultaneously melt processed with the fibers of the present invention to form webs containing more than one type of melt processed fiber, preferably, melt-blown microfiber. Webs having more than one type of fiber are referred to herein as having commingled constructions. In commingled constructions, the various types of fibers can be intimately mixed forming a substantially uniform cross-section, or they can be in separate layers. The web properties can be varied by the number of different fibers used, the number of intrafiber layers employed, and the layer arrangement. Other materials, such as surfactants or binders can also be incorporated into the web before, during, or after its collection, such as by the use of a spray jet.

The nonwoven webs of the present invention can be use din composite multi-layer structures. The other layers can be supporting webs, nonwoven webs of spun bond, staple, and/or melt-blown fibers, as well as films of elastic, semipermeable, and/or impermeable materials. These other layers can be used for absorbency, surface texture, rigidifucation, etc. They can be attached to the nonwoven webs of the fibers of the present invention using conventional techniques such as heat bonding, binders or adhesives, or mechanical engagement such as hydroentanglement or needle punching.

Webs or composite structures including the webs of the invention can be further processed after collection or assembly, such as by calendaring or point embossing to increase web strength, provide a patterned surface, or fuse fibers at contact points in a web structure or the like; by orientation to provide increased web strength; by needle punching; heat or molding operations; coating, such as with adhesives to provide a tape structure; or the like.

The nonwoven webs of the present invention can be used to prepare adhesive articles, such as tapes, including medical grade tapes, labels, wound dressings, and the like. That is, the pressure-sensitive adhesive nonwoven webs of the present invention can be used as the adhesive layer on a backing, such as paper, a polymeric film, or a woven or nonwoven web, to form an adhesive article. For example, a nonwoven web of the present invention can be laminated to at least one major surface of a backing. The nonwoven web forms the pressure-sensitive adhesive layer of the adhesive article.

EXAMPLES

The following examples are provided to illustrate presently contemplated preferred embodiments, but are not intended to be limiting thereof. All percentages and parts are by weight unless otherwise noted.

PEEL ADHESION TEST

Peel adhesion is the force required to remove a coated flexible sheet material from a test panel measured at a specific angle and rate of removal. This force is expressed in grams per 2.54 cm width of coated sheet.

A 12.5 mm width of the coated sheet was applied to the horizontal surface of a clean glass test plate with at least 12.7 lineal centimeters (cm) in firm contact with the glass using a hard rubber roller. The free end of the coated strip was doubled back nearly touching itself so the angle of removal was 180° and attached to the adhesion tester scale. The glass test plate was clamped in the jaws of a tensile testing machine which is capable of moving the plate away from the scale at a constant rate of 2.3 meters per minute. The scale reading in grams was recorded as the tape was peeled from the glass surface.

EXAMPLE 1

An acrylate based PSA web was prepared using a melt blowing process similar to that described, for example, in Wente, "Superfine Thermoplastic Fibers," in *Industrial Engineering Chemistry,* Vol. 48, pages 1342 et seq (1956) or in Report No. 4364 of the Naval Research Laboratories, published May 25, 1954, entitled "Manufacture of Superfine Organic Fibers" by Wente et al., except that the apparatus was connected to a melt-blowing die having circular smooth surfaces orifices (10/cm) (with a 5:1 length to diameter ratio. The feedblock assembly immediately preceding the melt blowing die, which was maintained at 220° C., was fed by stream of isooctyl acrylate/acrylic acid/styrene macromer (IOA/AA/Sty) terpolymer, the preparation of which is similar to that described in International Publication No. 96/26253 (Dunshee et al.) except that the IOA/AA/Sty ratio was 92/4/4 and the inherent viscosity of the terpolymer was approximately 0.65, at a temperature of 240° C.

A gear pump intermediate of the extruder and the feedblock assembly was adjusted to deliver the IOA/AA/Sty melt stream to the die, which was maintained at 225° C., at a rate of 178 grams/hour/centimeter (g/hr/cm) die width. The primary air was maintained at 220° C. and 241 kilopascals (KPa) with a 0.076 cm gap width, to produce a uniform web. The PSA web was collected on silicone coated kraft paper release liner (available from Daubert Coated Products, Dixon, Ill.) which passed around a rotating drum collector at a collector to die distance of 17.8 cm. The resulting PSA web, comprising PSA microfibers having an average diameter of less than about 25 $\mu$m, had a basis weight of 50 grams/square meter (g/m$^2$) and exhibited a peel strength to glass of 476.7 g/2.54 cm at a peel rate of 30.5 centimeter/minute (cm/min), 811.5 g/2.54 cm at a peel rate of 228.6 cm/min.

EXAMPLE 2

An acrylate functional methoxy poly(ethylene oxide) macromer (EOA) was prepared by melting CARBOWAX 750 (288 g, 0.4 M, a methoxy poly(ethylene oxide) ethanol of approximately 750 molecular weight (MW), available from Union Carbide Corp., Danbury, Conn.), in a reactor fitted with a Dean Stark trap, adding toluene (280 g), and refluxing the mixture under a nitrogen stream for approximately 2 hours to remove dissolved oxygen. Acrylic acid (33.8 g, 0.5 M, available from Aldrich Chemical Co., Milwaukee, Wis.), p-toluene sulfonic acid (9.2 g, and copper powder (0.16 g) were added to the reactor and the reaction mixture refluxed, with stirring and under a nitrogen atmosphere, for approximately 16 hours as the water generated by the reaction was collected in the Dean Stark trap. The reaction mixture was cooled to room temperature, calcium hydroxide (10 g) added, and the resulting mixture stirred at room temperature for approximately 2 hours. Suspended solids were removed from the reaction mixture by filtration through an inorganic filtration aid to produce an approximately 47.2% solids solution of the acrylate functional methoxy poly(ethylene oxide).

An IOA/AA/EOA terpolymer was prepared by charging isooctyl acrylate (21.0 g), the EOA macromer described above (9.54 go of the 47.2% solids solution), acrylic acid (4.2 g), 2,2'-azobisisobutyronitrile (0.06 g, available from E. I. DuPont DeNemours, Inc., Wilmington, Del.), isopropanol (5.7 g) and ethyl acetate (19.3 g) into a reactor and purging the reaction mixture with nitrogen (1 liter) for approximately 35 seconds. The reactor was sealed and placed in a rotating water bath, maintained at 55° C., for 24 hours. Solvents were removed from the reaction to provide the IOA/AA/EOA terpolymer.

An acrylate based PSA web was prepared essentially as described in EXAMPLE 1 except that the IOA/AA/Sty adhesive composition was replaced with an isooctyl acrylate/acrylic acid/ethylene oxide acrylate (IOA/AA/EOA, 70/15/15 parts by weight) terpolymer described above, the extruder temperature was maintained at 236° C., the die was maintained at a temperature of 228° C., the primary air was maintained at 225° C. and 282 KPa with a 0.076 cm gap width, and the collector to die distance was 10.2 cm. The thus produced PSA web had a basis weight of 62 g/m$^2$ and exhibited good qualitative adhesion to glass and polypropylene substrates.

EXAMPLE 3

An acrylate based PSA web was prepared essentially as described in EXAMPLE 1 except that the IOA/AA/Sty adhesive composition was replaced with an isooctyl acrylate/acrylic acid/ethylene oxide acrylate/methyl methacrylate tetrapolymer (IOA/AA/EOA/MMA, 70/9/15/6 parts by weight, prepared essentially as was the IOA/AA/EOA terpolymer described in Example 2, except that methyl methacrylate was added to the monomer charge and the charges were adjusted to the indicated ratio), the extruder temperature was maintained at 212° C., the die that was maintained at a temperature of 210° C., the primary air was maintained at 218° C. and 234 KPa with a 0.076 cm gap width and the collector to die distance was 20.3 cm. The thus produced PSA web had a basis weight of 55 g/m$^2$ and exhibited a peel strength to glass of 338 g/2.54 cm at a peel rate of 30.5 cm/min, 486 g/2.54 cm at a peel rate of 228.6 cm/min and a peel strength to polypropylene of 111 g/2.54 cm at a peel rate of 30.5 cm/min, 134 g/2.54 cm at a peel rate of 228.6 cm/min.

EXAMPLE 4

A PSA web was prepared essentially as described in Example 1 except that the apparatus utilized two extruders, each of which were connected to a gear pump which fed a two layer feedblock assembly immediately preceding the melt-blowing die. The feedblock assembly, which was maintained at 210° C., was fed by two polymer melt streams, one being a stream of the IOA/AA/EOA terpolymer described in EXAMPLE 2 maintained at a temperature of 210° C. and the other being a melt stream of the IOA/AA/Sty terpolymer described in Example 1 maintained at a temperature of 200° C.

The gear pumps were adjusted so that a 25/75 melt volume ratio of the IOA/AA/EOA terpolymer to the IOA/AA/Sty terpolymer was delivered to the feedblock and subsequently to the die, which was maintained at 210° C., at a rate of 178 g/hr/cm die width. The primary air was maintained at 218° C. and 234 KPa with a 0.076 cm gap width, and the collector to die distance was 20.3 cm .The thus produced PSA web, which was collected on a 1.2 mil (30 $\mu$m) biaxially oriented polypropylene (BOPP) film, had a basis weight of 54 g/m$^2$ and exhibited a peel strength to glass of 462 g/2.54 cm at a peel rate of 30.5 cm/min, 611 g/2.54 cm at a peel rate of 228.6 cm/min and a peel strength to polypropylene of 105 g/2.54 cm at a peel rate of 30.5 cm/min, 250 g/2.54 cm at a peel rate of 228.6 cm/min.

EXAMPLE 5

A PSA web was prepared essentially as described in EXAMPLE 4 except that the gear pumps were adjusted so that a 10/90 melt volume ratio IOA/AA/EOA terpolymer to the IOA/AA/Sty terpolymer was delivered to the die. The thus produced PSA web had a basis weight of 54 g/m$^2$ and exhibited a peel strength to glass of 406 g/2.54 cm at a peel rate of 30.5 cm/min, 556 g/2.54 cm at a peel rate of 228.6 cm/min and a peel strength to polypropylene of 184 g/2.54 cm at a peel rate of 30.5 cm/min, 238 g/2.54 cm at a peel rate of 228.6 cm/min.

EXAMPLE 6

A PSA web was prepared essentially as described in EXAMPLE 4 except that the IOA/AA/EOA terpolymer was replaced with the IOA/AA/EOA/MMA tetrapolymer described in EXAMPLE 3, which was maintained at a temperature of 210° C. The gear pumps were adjusted so that a 25/75 melt volume ratio of the IOA/AA/EOA/MMA tetrapolymer to the IOA/AA/Sty terpolymer was delivered to the die, which was maintained at 210° C., the primary air was maintained at 218° C. and 234 KPa with a 0.076 cm gap width, and the collector to die distance was 20.3 cm. The thus produced PSA web, which was collected on a 1.2 mil BOPP film, had a basis weight of 50 g/m$^2$ ad exhibited a peel strength to glass of 275 g/2.54 cm at a peel rate of 30.5 cm/min, 434 g/2.54 cm at a peel rate of 228.6 cm/min, and a peel strength to polypropylene of 113 g/2.54 cm at a peel rate of 30.5 cm/min, 193 g/2.54 cm at a peel rate of 228.6 cm/min.

EXAMPLE 7

A PSA web was prepared essentially as described in EXAMPLE 6 except that the gear pumps were adjusted so that a 10/90 melt volume ratio of the IOA/AA/EOA/MMA tetrapolymer to the IOA/AA/Sty terpolymer was delivered to the die and the collector to die distance was 24.1 cm. The thus produced PSA web had a basis weight of 50 g/m$^2$ and exhibited a peel strength to glass of 278 g/2.54 cm at a peel rate of 30.5 cm/min, 327 g/2.54 cm at a peel rate of 228.6 cm/min, and a peel strength to polypropylene of 74 g/2.54 cm at a peel rate of 30.5 cm/min, 295 g/2.54 cm at a peel rate of 228.6 cm/min.

EXAMPLE 8

A PSA web was prepared essentially as described in EXAMPLE 4 except that the IOA/AA/EOA terpolymer was replaced with EASTOFLEX D127S (a hexene/propylene copolymer, available from Eastman Chemical Company, Kingsport, Tenn.), which was delivered from an extruder maintained at a temperature of 210° C. The gear pumps were adjusted so that a 50/50 melt volume ratio of the EASTOFLEX D127S to the IOA/AA/Sty terpolymer was delivered to the die, which was maintained at 210° C., at a rate of 178 g/hr/cm die width and the primary air was maintained at 218° C. and 234 KPa with a 0.076 cm gap width. The thus produced PSA web had a basis weight of 50 g/m$^2$ and exhibited good qualitative adhesion to glass and polypropylene substrates.

EXAMPLE 9

A PSA web was prepared essentially as described in EXAMPLE 8 except that the gear pumps were adjusted so that a 25/75 melt volume ratio of the EASTOFLEX D127S to the IOA/AA/Sty terpolymer was delivered to the die. The thus produced PSA web had a basis weight of 52 g/m$^2$ and exhibited good qualitative adhesion to glass and polypropylene substrates.

EXAMPLE 10

A PSA web was prepared essentially as described in EXAMPLE 8 except that the gear pumps were adjusted so that a 10/90 melt volume ratio of the EASTOFLEX D127S to the IOA/AA/Sty terpolymer was delivered to the die. The thus produced PSA web had a basis weight of 52 g/m$^2$ and exhibited good qualitative adhesion to glass and polypropylene substrates.

EXAMPLE 11

A PSA web was prepared essentially as described in EXAMPLE 4 except that the two gear pumps fed a 3-layer feedblock splitter similar to that described in U.S. Pat. Nos. 3,480,502 (Chisholm et al.) and 3,487,505 (Schrenk). The feedblock split the IOA/AA/EOA melt stream and recombined it in an alternating manner with the IOA/AA/Sty melt stream into a 3-layer melt stream exiting the feedblock, the outermost layers of the exiting stream being the IOA/AA/EOA terpolymer. The IOA/AA/EOA terpolymer was delivered from an extruder maintained at 210° C. and the IOA/AA/Sty terpolymer was delivered from an extruder maintained at 200° C. The gear pumps were adjusted so that a 25/75 melt volume ratio of the IOA/AA/EOA terpolymer to the IOA/AA/Sty terpolymer was delivered to the die, which was maintained at 200° C. with a primary air temperature of 215° C. and 241 KPa with a 0.076 cm gap width. The web was collected on a 1.2 mil (30 $\mu$m) BOPP film which passed around a rotating drum collector at a collector to die distance of 20.3 cm. The resulting PSA web, comprising 3 layer microfibers having an average diameter of less than about 25 $\mu$m, had a basis weight of 55 g/m$^2$ and exhibited a peel strength to glass of 508 g/2.54 cm at a peel rate of 30.5 cm/min, 697 g/2.54 cm at a peel strength of 228.6 cm/min and a peel strength to polypropylene of 213 g/2.54 cm at a peel rate of 30.5 cm/min, 238 g/2.54 cm at a peel rate of 228.6 cm/min.

EXAMPLE 12

A PSA web was prepared essentially as described in EXAMPLE 11 except that the two gear pumps were adjusted so that a 10/90 melt volume ratio of the IOA/AA/EOA terpolymer to the IOA/AA/Sty terpolymer was delivered to the die. The resulting PSA web, comprising 3 layer microfibers having an average diameter of less than about 25 $\mu$m, had a basis weight of 54 g/m$^2$ and exhibited a peel strength to glass of 363 g/2.54 cm at a peel rate of 30.5 cm/mi, 618 g/2.54 cm at a peel rate of 228.6 cm/min and a peel strength to polypropylene of 136 g/2.54 cm at a peel rate of 30.5 cm, 261 g/2.54 cm at a peel rate of 228.6 cm/min.

EXAMPLE 13

A PSA web was prepared essentially as described in EXAMPLE 12 except that the IOA/AA/EOA terpolymer was replaced with Exxon 3795 polypropylene resin (available from Exxon Chemical Co., Houston, Tex.), which was delivered to one of the gear pumps at 210° C. The recombined melt stream was delivered to the die, which was maintained at 210° C., at a rate of 178 g/hr/cm die width and the primary air was maintained at 205° C. and 241 KPa with a 0.076 cm gap width. The thus produced PSA web had a basis weight of 55 g/m$^2$ and exhibited good qualitative adhesive properties to glass and polypropylene substrates.

EXAMPLE 14

A PSA web was prepared essentially as described in EXAMPLE 8 except that the feedblock was replaced with the 3-layer feedblock splitter described in Example 11. The feedblock split the EASTOFLEX D127S melt stream and recombined it in an alternating manner with the IOA/AA/Sty melt stream into a 3-layer melt stream exiting the feedblock, the outermost layers of the exiting stream being the EASTOFLEX D127S. The gear pumps were adjusted so that a 50/50 melt volume ratio of the EASTOFLEX D127S to the IOA/AA/Sty terpolymer was delivered to the die. The web was collected on a 1.2 mil (30 μm) BOPP film which passed around a rotating drum collector at a collector to die distance of 20.3 cm. The resulting PSA web, comprising 3 layer microfibers having an average diameter of less than about 25 μm, had a basis weight of 53 g/m$^2$ and exhibited a peel strength to glass of 213 g/2.54 cm at a peel rate of 30.5 cm/min, 216 g/2.54 cm at a peel rate of 228.6 cm/min and a peel strength to polypropylene of 247 g/2.54 cm at a peel rate of 30.5 cm/min, 298 g/2.54 cm at a peel rate of 228.6 cm/min.

EXAMPLE 15

A PSA web was prepared essentially as described in EXAMPLE 14 except that the two gear pumps were adjusted so that a 25/75 melt volume ratio of the EASTOFLEX D127S to the IOA/AA/Sty terpolymer was delivered to the die. The resulting PSA web, comprising 3 layer microfibers having an average diameter of less than about 25 μm, had a basis weight of 52 g/m$^2$ and exhibited a peel strength to glass of 275 g/2.54 cm at a peel rate of 30.5 cm/min, 241 g/2.54 cm at a peel rate of 228.6 cm/min and a peel strength to polypropylene of 267 g/2.54 cm at a peel rate of 30.5 cm/min, 431 g/2.54 cm at a peel rate of 228.6 cm/min.

EXAMPLE 16

A PSA web was prepared essentially as described in EXAMPLE 14 except that the two gear pumps were adjusted so that a 10/90 melt volume ratio of the EASTOFLEX D127S to the IOA/AA/Sty terpolymer was delivered to the die. The resulting PSA web, comprising 3 layer microfibers having an average diameter of less than about 25 μm, had a basis weight of 52 g/m$^2$ and exhibited a peel strength to glass of 270 g/2.54 cm at a peel rate of 30.5 cm/min, 392 g/2.54 cm at a peel rate of 228.6 cm/min and a peel strength to polypropylene of 227 g/2.54 cm at a peel rate of 30.5 cm/min, 329 g/2.54 cm at a peel rate of 228.6 cm/min.

EXAMPLE 17

A PSA web was prepared essentially as described in EXAMPLE 11 except that the IOA/AA/Sty terpolymer was replaced with Dow polyethylene resin PE 6806 (available from Dow Chemical, Midland, Mich.) which was delivered to one of the gear pumps at 212° C. The gear pumps were adjusted so that a 50/50 melt volume ratio of the IOA/AA/EOA terpolymer to the Dow PE6806 resin was delivered to the die, which was maintained at 220° C. and the primary air was maintained at 227° C. and 283 KPa with a 0.076 cm gap width. The web was collected on a silicone coated kraft paper release liner (available from Daubert Coated Products) which passed around a rotating drum collector at a collector to die distance of 10.2 cm. The resulting PSA web, comprising 3 layer microfibers having an average diameter of less than about 25 μm, had a basis weight of 58 g/m$^2$ and exhibited good qualitative adhesive properties to glass and polypropylene substrates.

EXAMPLE 18

A PSA web was prepared essentially as described in EXAMPLE 11 except that the IOA/AA/EOA terpolymer was replaced with ZYTEL 151L Nylon 6,12 (available from E. I. DuPont Nemours, Inc., Wilmington, Del.) which was delivered to one of the two gear pumps at 235° C. The feedblock split the IOA/AA/Sty melt stream and recombined it in an alternating manner with the ZYTEL nylon melt stream into a 3 layer melt stream exiting the feedblock, the outermost layers of the exiting stream being the IOA/AA/Sty terpolymer. The gear pumps were adjusted so that a 90/10 melt volume ratio of the IOA/AA/Sty terpolymer to the ZYTEL resin was delivered to the die, which was maintained at 220° C. and the primary air was maintained at 220° C. and 248 KPa with a 0.076 cm gap width. The resulting PSA web, comprising 3 layer microfibers having an average diameter of less than about 25 μm, had a basis weight of 107 g/m$^2$ was laminated to a 1.4 mil (36 μm) poly(ethylene terephthalate) film and the resulting laminate tape construction evaluated for adhesive properties. The tape exhibited a peel strength to glass of 80 g/2.54 cm at a peel rate of 30.5 cm/min, 128 g/2.54 cm at a peel rate of 228.6 cm/min.

EXAMPLE 19

A PSA web was prepared essentially as described in EXAMPLE 18 except that the gear pumps were adjusted so that a 80/20 melt volume ratio of the IOA/AA/Sty terpolymer to the ZYTEL 151L resin was delivered to the die. The resulting PSA web, comprising 3 layer microfibers having an average diameter of less than about 25 μm, had a basis weight of 110 g/m$^2$ and exhibited a peel strength to glass of 34 g/2.54 cm at a peel rate of 30.5 cm/min, 51 g/2.54 cm at a peel rate of 228.6 cm/min.

EXAMPLE 20

A PSA nonwoven web based on single component fibers using an acrylate blend was prepared essentially as described in EXAMPLE 1 except that the IOA/AA/Sty adhesive composition was replaced with a precompounded 10/90 blend of a IOA/AA/Sty terpolymer and a KRATON based PSA composition consisting of a 100 parts per hundred parts elastomer (phr) of KRATON D1112, 80 phr ESCOREZ 1310LC, 20 phr ZONAREZ A25, 4 phr IRGANOX 1076 antioxidant (available from CIBA-GEIGY Corp., Hawthorne, N.Y.), and 4 phr TINUVIN 328 UV stabilizer (available from CIBA-GEIGY Corp.), which was delivered to the die at a temperature of 210° C., the primary air was maintained at 212° C. and 234 KPa with a 0.076 cm gap width, and the collector to die distance was 17.8 cm. The thus produced PSA web, comprising microfibers having an average diameter of less than about 25 μm, was collected on a 1.5 mil (37 μm) poly(ethylene terephthalate film which passed around a rotating drum collector at a collector to die distance of 17.8 cm, had a basis weight of 48 g/m$^2$ and exhibited a peel strength to glass of 1021 b/2.54 cm at a peel rate of 30.5 g/2.54 cm, 2119 g/2.54 cm at a peel rate of 228.6 cm/min and a peel strength to polypropylene of 2053 g/2.54 cm at a peel rate of 228.6 cm/min.

EXAMPLE 21

A PSA nonwoven web was prepared essentially as described in EXAMPLE 20 except that the PSA composition consisted of a 25/75 blend of the IOA/AA/Sty terpolymer with the KRATON based PSA formulation which was delivered to the die at a temperature of 210° C., and the primary air was maintained at 190° C. and 152 KPa with a 0.076 cm gap width. The web was collected on a silicone coated kraft paper release liner which passed around a rotating drum collector at a collector to die distance of 20.3 cm. and laminated to a 1.5 mil (37 μm) poly(ethylene terephthalate) film for adhesive property evaluations. The thus produced PSA web, comprising microfibers having an average diameter of less than about 25 μm, has a basis weight of 49 g/m$^2$ and exhibited a peel strength to glass of 788 g/2.54 cm at a peel rate of 30.5 cm/min, 1157 g/2.54 cm at a peel rate of 228.6 cm/min and a peel strength to polypropylene of 658 g/2.54 cm at a peel rate of 30.5 cm/min, 698 g/2.54 cm at a peel rate of 228.6 cm/min.

EXAMPLE 22

A PSA web was prepared essentially as described in EXAMPLE 20 except that the PSA composition consisted of a 50/50 blend of the IOA/AA/Sty terpolymer with the KRATON based formulation. The thus produced PSA web, comprising microfibers having an average diameter of less than about 25 μm, had a basis weight of 50 g/m$^2$ exhibited a peel strength to glass of 618 g/2.54 cm at a peel rate of 30.5 cm/min, 1106 g/2.54 cm at a peel rate of 228.6 cm/min, and a peel strength to polypropylene of 358 g/2.54 cm at a peel rate of 30.5 cm/min, 358 g/2.54 cm at a peel rate of 228.6 cm/min.

EXAMPLE 23

A PSA web was prepared essentially as described in EXAMPLE 20 except that the PSA composition consisted of a 75/25 blend of the IOA/AA/Sty terpolymer with the KRATON based formulation, the primary air was maintained at 212° C. and 234 KPa with a 0.076 cm gap width. The web was collected on a silicone coated kraft paper release liner which passed around a rotating drum collector at a collector to die distance of 17.8 cm and subsequently laminated to a 1.5 mil (37 μm) poly(ethylene terephthalate) film for adhesive property evaluations. The thus produced PSA web, comprising microfibers having an average diameter of less than about 25 μm, had a basis weight of 50 g/m$^2$ and exhibited a peel strength to glass of 743 g/2.54 cm at a peel rate of 30.5 cm/min, 1542 g/2.54 cm at a peel rate of 228.6 cm/min and a peel strength to polypropylene of 655 g/2.54 cm at a peel rate of 228.6 cm/min.

EXAMPLE 24

A PSA web was prepared essentially as described in EXAMPLE 23 except that the IOA/AA/Sty adhesive composition was replaced with a 90/10 blend of the IOA/AA/Sty terpolymer with the KRATON based formulation. The thus produced PSA web, comprising microfibers having an average diameter of less than about 25 μm, had a basis weight of 50 g/m$^2$ and exhibited a peel strength to glass of 805 g/2.54 cm at a peel rate of 30.5 cm/min, 1264 g/2.54 cm at a peel rate of 228.6 cm/min, and a peel strength to polypropylene of 343 g/2.54 cm at a peel rate of 228.6 cm/min.

EXAMPLE 25

A PSA web was prepared essentially as described in EXAMPLE 11 except that one extruder delivered a melt stream of the precompounded 50/50 blend of the IOA/AA/Sty terpolymer with the KRATON/ESCOREZ/ZONAREZ PSA formulation described in EXAMPLE 20 and the other extruder delivered a melt stream of the KRATON/ESCOREZ/ZONAREZ PSA formulation described in EXAMPLE 20. The feedblock split the KRATON melt stream and recombined it in an alternating manner with the IOA/AA/Sty and KRATON blend melt stream into a 3 layer melt stream exiting the feedblock, the outermost layer of the exiting stream being the KRATON/ESCOREZ/ZONAREZ PSA formulation. The gear pumps were adjusted so that a 75/25 melt volume ratio of the IOA/AA/Sty/KRATON blend to the KRATON/ESCOREZ/ZONAREZ multilayer melt stream was delivered to the die, which was maintained at 210° C. and the primary air was maintained at 190° C. and 179 KPa with a 0.076 cm gap width. The web was collected on a silicone coated kraft paper release liner which passed around a rotating drum collector at a collector to die distance of 20.3 cm and subsequently laminated to a 1.5 mil (37 μm) BOPP film for adhesive property evaluations. The resulting PSA web, comprising 3 layer microfibers having an average diameter of less than about 25 μm, had a basis weight of 52 g/m$^2$ and exhibited a peel strength to glass of 508 g/2.54 cm at a peel rate of 30.5 cm/min, 822 g/2.54 cm at a peel rate of 228.6 cm/min, and a peel strength to polypropylene of 375 g/2.54 cm at a peel rate of 30.5 cm/min, 887 g/2.54 cm at a peel rate of 228.6 cm/min.

EXAMPLE 26

A PSA web was prepared essentially as described in EXAMPLE 25 except that gear pumps were adjusted so that a 50/50 melt volume ratio of the IOA/AA/Sty//KRATON blend to the KRATON/ESCOREZ/ZONAREZ was delivered to the die. The resulting PSA web, comprising 3 layer microfibers having an average diameter of less than about 25 μm, had a basis weight of 54 g/m$^2$ and exhibited a peel strength to glass of 511 g/2.54 cm at a peel rate of 30.5 cm/min, 1063 g/2.54 cm at a peel rate of 228.6 cm/min, and a peel strength to polypropylene of 601 g/2.54 cm at a peel rate of 30.5 cm/min, 663 g/2.54 cm at a peel rate of 228.6 cm/min.

EXAMPLE 27

A PSA web was prepared essentially as described in EXAMPLE 25 except that gear pumps were adjusted so that a 25/75 melt volume ratio of the IOA/AA/Sty/KRATON blend to the KRATON/ESCOREZ/ZONAREZ multilayer melt stream was delivered to the die. The resulting PSA web, comprising 3 layer microfibers having an average diameter of less than about 25 μm, had a basis weight of 52 g/m$^2$ and exhibited a peel strength to glass of 587 g/2.54 cm at a peel rate of 30.5 cm/min, 1055 g/2.54 cm at a peel rate of 228.6 cm/min, and a peel strength to polypropylene of 516 g/2.54 cm at a peel rate of 30.5 cm/min, 845 g/2.54 cm at a peel rate of 228.6 cm/min.

EXAMPLE 28

A PSA web was prepared essentially as described in EXAMPLE 25 except that the KRATON/ESCOREZ/ZONAREZ formulation was replaced by the IOA/AA/Sty terpolymer of EXAMPLE 1. The gear pumps were adjusted so that a 75/25 melt volume ratio of the IOA/AA/Sty/KRATON blend to the IOA/AA/Sty terpolymer multilayer melt stream was delivered to the die, which was maintained at 220° C. and the primary air was maintained at 200° C. and 179 KPa with a 0.076 cm gap width. The resulting PSA web, comprising 3 layer microfibers having an average diameter of less than about 25 $\mu$m, had a basis weight of 52 g/m$^2$ and exhibited a peel strength to glass of 627 g/2.54 cm at a peel rate of 30.5 cm/min, 913 g/2.54 cm at a peel rate of 228.6 cm/min, and a peel strength to polypropylene of 289 g/2.54 cm at a peel rate of 30.5 cm/min, 700 g/2.54 cm at a peel rate of 228.6 cm/min.

EXAMPLE 29

A PSA web was prepared essentially as described in EXAMPLE 28 except that the gear pumps were adjusted so that a 50/50 melt volume ratio of the IOA/AA/Sty//KRATON blend to the IOA/AA/Sty terpolymer multilayer melt stream was delivered to the die. The resulting PSA web, comprising 3 layer microfibers having an average diameter of less than about 25 $\mu$m, had a basis weight of 50 g/m$^2$ and exhibited a peel strength to glass of 491 g/2.54 cm at a peel rate of 30.5 cm/min, 689 g/2.54 cm at a peel rate of 228.6 cm/min, and a peel strength to polypropylene of 213 g/2.54 cm at a peel rate of 30.5 cm/min, 485 g/2.54 cm at a peel rate of 228.6 cm/min.

EXAMPLE 30

A PSA web was prepared essentially as described in EXAMPLE 28 except that the gear pumps were adjusted so that a 25/75 melt volume ratio of the IOA/AA/STY//KRATON blend to the IOA/AA/Sty terpolymer multilayer melt stream was delivered to the die. The resulting PSA web, comprising 3 layer microfibers having an average diameter of less than about 25 $\mu$m, had a basis weight of 52 g/m$^2$ and exhibited a peel strength to glass of 491 g/2.54 cm at a peel rate of 30.5 cm/min, 632 g/2.54 cm at a peel rate of 228.6 cm/min, and a peel strength to polypropylene of 167 g/2.54 cm at a peel rate of 30.5 cm/min, 275 g/2.54 cm at a peel rate of 228.6 cm/min.

All patents, patent applications, and publications cited herein are each incorporated by reference, as if individually incorporated. The various modifications and alterations of this invention will be apparent to those skilled in the art without departing from the scope and spirit of this invention. This invention should not be restricted to that set forth herein for illustrative purposes.

What is claimed is:

1. A pressure-sensitive adhesive fiber comprising a pressure-sensitive adhesive composition comprising a crosslinked melt-processable acrylate copolymer as a structural component of the fiber, wherein the crosslinked melt-processable acrylate copolymer comprises copolymerized monomers comprising at least one monofunctional alkyl (meth)acrylate monomer, at least one monofunctional free-radically copolymerizable reinforcing monomer having a homopolymer glass transition temperature higher than that of the alkyl (meth)acrylate monomer, and a crosslinking agent; wherein the crosslinking agent crosslinks subsequent to fiber formation.

2. The fiber of claim 1 wherein the alkyl (meth)acrylate monomer when homopolymerized has a glass transition temperature of no greater than about 0° C., and wherein the free-radically copolymerizable reinforcing monomer when homopolymerized has a glass transition temperature of at least about 10° C.

3. The fiber of claim 1 further comprising at least one secondary melt processable polymer or copolymer mixed with the acrylate copolymer.

4. The fiber of claim 3 wherein the secondary melt processable polymer or copolymer is selected from the group of a polyolefin, a polystyrene, a polyurethane, a polyester, a polyamide, a styrenic block copolymer, an epoxy, a vinyl acetate, and mixtures thereof.

5. The fiber of claim 4 wherein the secondary melt processable polymer or copolymer is a tackified styrenic block copolymer.

6. The fiber of claim 1 wherein the pressure-sensitive adhesive composition further comprises a tackifier mixed with the acrylate copolymer.

7. The fiber of claim 1 wherein the acrylate copolymer has an apparent viscosity in the melt in a range of about 150 poise to about 800 poise.

8. The fiber of claim 1 wherein the monofunctional alkyl (meth)acrylate monomer is selected from the group of 2-methylbutyl acrylate, isooctyl acrylate, lauryl acrylate, poly(ethoxylated) methoxy acrylate, and mixtures thereof.

9. The fiber of claim 1 wherein the free-radically copolymerizable reinforcing monomer is a monofunctional (meth)acrylic monomer.

10. The fiber of claim 9 wherein the monofunctional (meth)acrylic reinforcing monomer is selected from the group of an acrylic acid, a methacrylic acid, an acrylate, an acrylamide, and mixtures thereof.

11. The fiber of claim 10 wherein the monofunctional (meth)acrylic reinforcing monomer is selected from the group of acrylic acid, N,N-dimethyl acrylamide, 1,1,3,3-tetramethylbutyl acrylamide, 2-hydroxypropyl acrylate, 2-(phenoxy)ethyl acrylate, and mixtures thereof.

12. The fiber of claim 1 wherein the crosslinking agent is copolymerized with the monofunctional alkyl (meth) acrylate monomer and the reinforcing monomers.

13. The fiber of claim 12 wherein the crosslinking agent is selected from the group of an acrylic crosslinking monomer, a polymeric crosslinking material having a copolymerizable vinyl group, and mixtures thereof.

14. The fiber of claim 13 wherein the polymeric material having a copolymerizable vinyl group is selected from the group of a (meth)acrylate-terminated polystyrene macromer and a (meth)acrylate-terminated polymethyl methacrylate macromer.

15. The fiber of claim 1 wherein the crosslinking agent forms chemical crosslinks.

16. The fiber of claim 1 wherein the crosslinking agent forms physical crosslinks.

17. A pressure-sensitive adhesive fiber which is in the form of a multilayer fiber comprising at least a first layer comprising a pressure-sensitive adhesive composition comprising an acrylate copolymer as a structural component of the fiber, wherein the acrylate copolymer comprises copolymerized monomers comprising at least one monofunctional alkyl (meth)acrylate monomer and at least one monofunctional free-radically copolymerizable reinforcing monomer having a homopolymer glass transition temperature higher than that of the alkyl (meth)acrylate monomer.

18. The fiber of claim 17 further comprising at least a second layer comprising a different acrylate copolymer.

19. The fiber of claim 17 further comprising at least a second layer comprising a secondary melt processable polymer or copolymer.

20. The fiber of claim 19 wherein the secondary melt processable polymer or copolymer is selected from the group of a polyolefin, a polystyrene, a polyurethane, a polyester, a polyamide, a styrenic block copolymer, an epoxy, a vinyl acetate, and mixtures thereof.

21. The fiber of claim 20 wherein the secondary melt processable polymer or copolymer is a tackified styrenic block copolymer.

22. The fiber of claim 19 wherein the secondary melt processable polymer or copolymer is mixed with a tackifier.

23. A nonwoven web comprising pressure-sensitive adhesive fibers; wherein the fibers comprise a pressure-sensitive adhesive composition comprising a crosslinked melt-processable acrylate copolymer as a structural component of the fibers; wherein the crosslinked melt-processable acrylate copolymer comprises copolymerized monomers comprising at least one monofunctional alkyl (meth)acrylate monomer, at least one monofunctional free-radically copolymerizable reinforcing monomer having a homopolymer glass transition temperature higher than that of the alkyl (meth)acrylate monomer, and a crosslinking agent; wherein the crosslinking agent crosslinks subsequent to fiber formation.

24. The nonwoven web of claim 23 wherein the alkyl (meth)acrylate monomer when homopolymerized has a glass transition temperature of no greater than about 0° C., and wherein the free-radically copolymerizable reinforcing monomer when homopolymerized has a glass transition temperature of at least about 10° C.

25. The nonwoven web of claim 23 wherein the fibers further comprise at least one secondary melt processable polymer or copolymer mixed with the acrylate copolymer.

26. The nonwoven web of claim 25 wherein the secondary melt processable polymer or copolymer is selected from the group of a polyolefin, a polystyrene, a polyurethane, a polyester, a polyamide, a styrenic block copolymer, an epoxy, a vinyl acetate, and mixtures thereof.

27. The nonwoven web of claim 26 wherein the secondary melt processable polymer or copolymer is a tackified styrenic block copolymer.

28. The nonwoven web of claim 23 wherein the pressure-sensitive adhesive composition of the fibers further comprises a tackifier mixed with the acrylate copolymer.

29. The nonwoven web of claim 23 wherein the acrylate copolymer has an apparent viscosity in the melt in a range of about 150 poise to about 800 poise.

30. The nonwoven web of claim 23 wherein the monofunctional alkyl (meth)acrylate monomer is selected from the group of 2-methylbutyl acrylate, isooctyl acrylate, lauryl acrylate, poly(ethoxylated) methoxy acrylate, and mixtures thereof.

31. The nonwoven web of claim 23 wherein the free-radically copolymerizable reinforcing monomer is a monofunctional (meth)acrylic monomer.

32. The nonwoven web of claim 31 wherein the monofunctional (meth)acrylic reinforcing monomer is selected from the group of an acrylic acid, a methacrylic acid, an acrylate, an acrylamide, and mixtures thereof.

33. The nonwoven of claim 32 wherein the monofunctional (meth)acrylic reinforcing monomer is selected from the group of acrylic acid, N,N-dimethyl acrylamide, 1,1,3,3-tetramethylbutyl acrylamide, 2-hydroxypropyl acrylate, 2-(phenoxy)ethyl acrylate, and mixtures thereof.

34. The nonwoven web of claim 23 wherein the crosslinking agent is copolymerized with the monofunctional alkyl (meth)acrylate monomer and the reinforcing monomer.

35. The nonwoven web of claim 34 wherein the crosslinking agent is selected from the group consisting of an acrylic crosslinking monomer, a polymeric crosslinking material having a copolymerizable vinyl group, and mixtures thereof.

36. The nonwoven web of claim 35 wherein the polymeric material having a copolymerizable vinyl group is selected from the group of a (meth)acrylate-terminated polystyrene macromer and a (meth)acrylate-terminated polymethyl methacrylate macromer.

37. The nonwoven web of claim 23 further comprising fibers selected from the group of thermoplastic fibers, carbon fibers, glass fibers, mineral fibers, organic binder fibers, and mixtures thereof.

38. The nonwoven web of claim 23 further comprising particulate material.

39. The nonwoven web of claim 23 wherein the crosslinking agent forms chemical crosslinks.

40. The nonwoven web of claim 23 wherein the crosslinking agent forms physical crosslinks.

41. The nonwoven web of claim 23 wherein each fiber is in the form of a multilayer fiber comprising at least a first layer comprising an acrylate copolymer.

42. The nonwoven web of claim 41 wherein each fiber further comprises at least a second layer comprising a pressure-sensitive adhesive composition comprising a different acrylate copolymer.

43. The nonwoven web of claim 41 wherein each fiber further comprises at least a second layer comprising a secondary melt processable polymer or copolymer.

44. The nonwoven web of claim 43 wherein the secondary melt processable polymer or copolymer is selected from the group of a polyolefin, a polystyrene, a polyurethane, a polyester, a polyamide, a styrenic block copolymer, an epoxy, a vinyl acetate, and mixtures thereof.

45. The nonwoven web of claim 44 wherein the secondary melt processable polymer or copolymer is a tackified styrenic block copolymer.

46. The nonwoven web of claim 43 wherein the secondary melt processable polymer or copolymer is mixed with a tackifier.

47. An adhesive article comprising a backing and a layer of a nonwoven web laminated to at least one major surface of the backing; wherein the nonwoven web comprises pressure-sensitive adhesive fibers; wherein the fibers comprise a pressure-sensitive adhesive composition comprising a crosslinked melt-processable acrylate copolymer as a structural component of the fibers; wherein the crosslinked melt-processable acrylate copolymer comprises copolymerized monomers comprising at least one monofunctional alkyl (meth)acrylate monomer, at least one monofunctional free-radically copolymerizable reinforcing monomer having a homopolymer glass transition temperature higher than that of the alkyl (meth)acrylate monomer, and a crosslinking agent; wherein the crosslinking agent crosslinks subsequent to fiber formation.

48. The adhesive article of claim 47 wherein each fiber is in the from of a multilayer fiber comprising at least a first layer comprising a acrylate copolymer.

49. An adhesive article comprising a backing and a layer of nonwoven web laminated to at least one major surface of the backing; wherein the nonwoven web comprises pressure-sensitive adhesive fibers; wherein each fiber is in the form of a multilayer fiber comprising at least a first layer comprising a pressure-sensitive adhesive composition comprising an acrylate copolymer as a structural component of the fibers; wherein the acrylate copolymer comprises copolymerized monomers comprising at least one monofunctional alkyl (meth)acrylate monomer and at least one monofunctional free-radically copolymerizable reinforcing monomer having a homopolymer glass transition temperature higher than that of the alkyl (meth)acrylate monomer.

50. A pressure-sensitive adhesive fiber comprising a pressure-sensitive adhesive composition comprising a crosslinked acrylate copolymer as a structural component of the fiber; wherein the crosslinked acrylate copolymer comprises copolymerized monomers comprising at least one monofunctional alkyl (meth)acrylate monomer, at least one monofunctional free-radically copolymerizable reinforcing monomer having a homopolymer glass transition temperature higher than that of the alkyl (meth)acrylate monomer, and a crosslinking agent; wherein the crosslinking agent crosslinks subsequent to fiber formation; and further wherein the pressure-sensitive adhesive composition includes at least one secondary melt processable polymer or copolymer selected from the group of a polyolefin, a polystyrene, a polyurethane, a polyester, a polyamide, a styrenic block copolymer, an epoxy, a vinyl acetate, and mixtures thereof.

51. The fiber of claim 50 wherein the secondary melt processable polymer or copolymer is a tackified styrenic block copolymer.

52. A nonwoven web comprising pressure-sensitive adhesive fibers; wherein the fibers comprise a pressure-sensitive adhesive composition comprising a crosslinked acrylate copolymer as a structural component of the fibers; wherein the crosslinked acrylate copolymer comprises copolymerized monomers comprising at least one monofunctional alkyl (meth)acrylate monomer, at least one monofunctional free-radically copolymerizable reinforcing monomer having a homopolymer glass transition temperature higher than that of the alkyl (meth)acrylate monomer, and a crosslinking agent; wherein the crosslinking agent crosslinks subsequent to fiber formation; and further wherein the pressure-sensitive adhesive composition further includes at least one secondary melt processable polymer or copolymer selected from the group of a polyolefin, a polystyrene, a polyurethane, a polyester, a polyamide, a styrenic block copolymer, an epoxy, a vinyl acetate, and mixtures thereof.

53. The nonwoven web of claim 52 wherein the secondary melt processable polymer or copolymer is a tackified styrenic block copolymer.

* * * * *

UNITED STATES PATENT AND TRADEMARK OFFICE

CERTIFICATE OF CORRECTION

PATENT NO. : 6,083,856 
DATED : July 4, 2000
INVENTOR(S) : Eugene G. Joseph, Ashish Khandpur, Kenneth C. Williams, Anthony R. Clanton Steven C. Stickels and Randy A. Hoff It is certified that error appears in the above-identified patent and that said Letters Patent is hereby corrected as shown below:

Column 7,
Line 10, please delete “Hussman” and insert -- Husman --.

Column 12,
Lines 32-33, please delete “use din” and insert -- used in --.
Line 38, please delete “rigidifucation” and insert -- rigidification --.

Signed and Sealed this

Twenty-fifth Day of June, 2002

*Attest:*

*Attesting Officer*

JAMES E. ROGAN
*Director of the United States Patent and Trademark Office*